US007334699B2

(12) United States Patent
Keffeler et al.

(10) Patent No.: US 7,334,699 B2
(45) Date of Patent: Feb. 26, 2008

(54) FILLER ASSEMBLY FOR MEDICATION DISPENSER

(76) Inventors: Mark G. Keffeler, 21509 Ridgewood Rd., Elkhorn, NE (US) 68022; David P. Keffeler, 6606 N. 144th St., Omaha, NE (US) 68116

( * ) Notice: Subject to any disclaimer, the term of this patent is extended or adjusted under 35 U.S.C. 154(b) by 311 days.

(21) Appl. No.: 11/265,540

(22) Filed: Nov. 2, 2005

(65) Prior Publication Data

US 2007/0029339 A1 Feb. 8, 2007

Related U.S. Application Data

(60) Provisional application No. 60/705,082, filed on Aug. 3, 2005.

(51) Int. Cl.
*B65H 3/44* (2006.01)

(52) U.S. Cl. ..... 221/93; 221/156; 221/264; 221/268; 221/200

(58) Field of Classification Search ..... 221/93, 221/156, 264, 268, 200, 64
See application file for complete search history.

(56) References Cited

U.S. PATENT DOCUMENTS

| | | | | |
|---|---|---|---|---|
| 3,545,164 | A * | 12/1970 | Middleton | 53/446 |
| 5,415,321 | A * | 5/1995 | Gehlert et al. | 221/68 |
| 5,737,902 | A * | 4/1998 | Aylward | 53/475 |
| 5,829,632 | A * | 11/1998 | Gehlert et al. | 221/268 |
| 6,497,083 | B1 * | 12/2002 | Garwood et al. | 53/244 |
| 6,761,010 | B1 * | 7/2004 | Gibson | 53/390 |

* cited by examiner

*Primary Examiner*—Gene Crawford
*Assistant Examiner*—Timothy R Waggoner
(74) *Attorney, Agent, or Firm*—Thomte Law Office LLC; Dennis L. Thomte

(57) ABSTRACT

A filler assembly capable of filling unit-of-use medication containers or dispensers. In an embodiment, the filler assembly includes a generally trough-shaped top with a generally horizontal bottom including apertures surrounded by multiple sidewalls. Further, a body including a plurality of sides and ends is coupled to the top for transferring medication from the top to the medication dispenser. The plurality of sides includes a plurality of chutes covered by a transparent cover. Additionally, a base for supporting the filler assembly is included. The base bottom includes a plurality of apertures and positioners. The plurality of apertures extend through the base whereby each aperture aligns with one of the plurality of chutes. Moreover, a slide is coupled to at least one of the body and the base for controlling the dispensing of medication by a user.

5 Claims, 7 Drawing Sheets

FILLER ASSEMBLY FOR MEDICATION DISPENSER

CROSS REFERENCE TO RELATED APPLICATIONS

The present application claims the benefit under 35 U.S.C. § 119(e) of U.S. Provisional Patent Application Ser. No. 60/705,082, entitled "Filler Assembly for Medication Dispenser," filed Aug. 3, 2005 which is herein incorporated by reference in its entirety.

FIELD OF THE INVENTION

The present invention relates generally to the field of medication dispensers and more particularly to a filler assembly for a multiple unit container including several dose compartments.

BACKGROUND OF THE INVENTION

Due to a continuing rise in the number of prescriptions being given to patients and needing to be filled, as well as the increased need for pharmacist care services and face-to-face pharmacist patient counseling, automation behind the pharmacy counter is becoming not just desirable, but necessary. For example, with the increased demands placed upon pharmacists and pharmacy staff, not only does the time in which a patient must wait for the filling of the patients prescriptions increase, but the possibility for mistakes in the filling of such prescription increases.

One solution for increasing the efficiency with which prescriptions may be filled is the use of a robotic system interfaced with a computer. For instance, to fill a prescription with such a system a pharmacist first enters the number of tablets needed into the computer. Once quantity has been entered, the pharmacist may select the storage cell which contains the desired tablets or capsules. Upon selection, the tablets or capsules are automatically delivered into a holding compartment until released by the pharmacist into the prescription vial.

Although employment of a robotic system to fill prescriptions has increased the accuracy as well as the efficiency of dispensing medications, the robotic system is disadvantageous under certain circumstances. For example, in order to justify the expense of a robotic system hundreds of prescriptions need to filled daily. Thus, such system is not feasible for smaller pharmacies, hospitals, or health care facilities. In addition, such systems may be complex and difficult to use. Further, while the conventional robotic system is capable of filling prescription vials which contain multiple pills such a system is not designed to fill unit-of-use containers or dispensers. For example, in an effort to monitor patient compliance with a certain drug therapy it is often desirable to package medication in single-unit containers designed so that the contents are to be administered to the patient as a single-dose, direct from the container.

Therefore, it would be desirable to design an assembly for filling prescriptions which increases the efficiency and accuracy of dispensing of the medication, is low in cost and simple to use. It would be further desirable to design an assembly capable of filling unit-of-use medication containers or dispensers.

SUMMARY OF THE INVENTION

Accordingly, the present invention is directed to a filling assembly for filling a unit-of-use medication container or dispenser. In an embodiment, the filler assembly includes a generally trough-shaped top formed by a generally horizontal bottom surrounded by multiple sidewalls. In the embodiment, the generally horizontal bottom includes apertures. Further, a body is operationally coupled to the top for transferring medication from the top of the filler assembly to the medication dispenser. As such, the body includes a plurality of sides and ends arranged to form a generally rectangular body. In an exemplary embodiment, the body includes two sides and two ends. In such embodiment, the two sides include a plurality of chutes covered by a transparent cover. The plurality of chutes are aligned with the apertures within the top. Additionally, a base for supporting the filler assembly and facilitating the coupling of the filler assembly to the medication dispenser is included. The base bottom includes a plurality of apertures and positioners. The plurality of apertures extend through the base whereby each aperture aligns with one of the plurality of chutes. Moreover, a slide is coupled to at least one of the body and the base for controlling the dispensing of medication by a user.

During exemplary use, medication may be loaded into the filler assembly by pouring the tablets into the top of the filler assembly. The tablets then enter the body of the filler assembly through the apertures disposed within the top of the filler assembly. Such tablets may be stored in the chutes of the body until use. Medication is dispensed into the multiple compartments of a unit-of-use medication dispenser by the user aligning the plurality of positioners disposed within the base bottom with the medication dispenser and sliding the slide of the filler assembly. The sliding of the slide releases an individual tablet into each of the compartments within the medication dispenser.

In specific embodiments of the present invention, the plurality of positioners may be disposed around the outer and the inner periphery of the base bottom. Further, such positioners may be generally V-shaped. In additional embodiments, the body includes a pill gauge for measuring pill size. Moreover, the top may include a cover for covering the filler assembly and providing protection of the contents therein while not in use.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
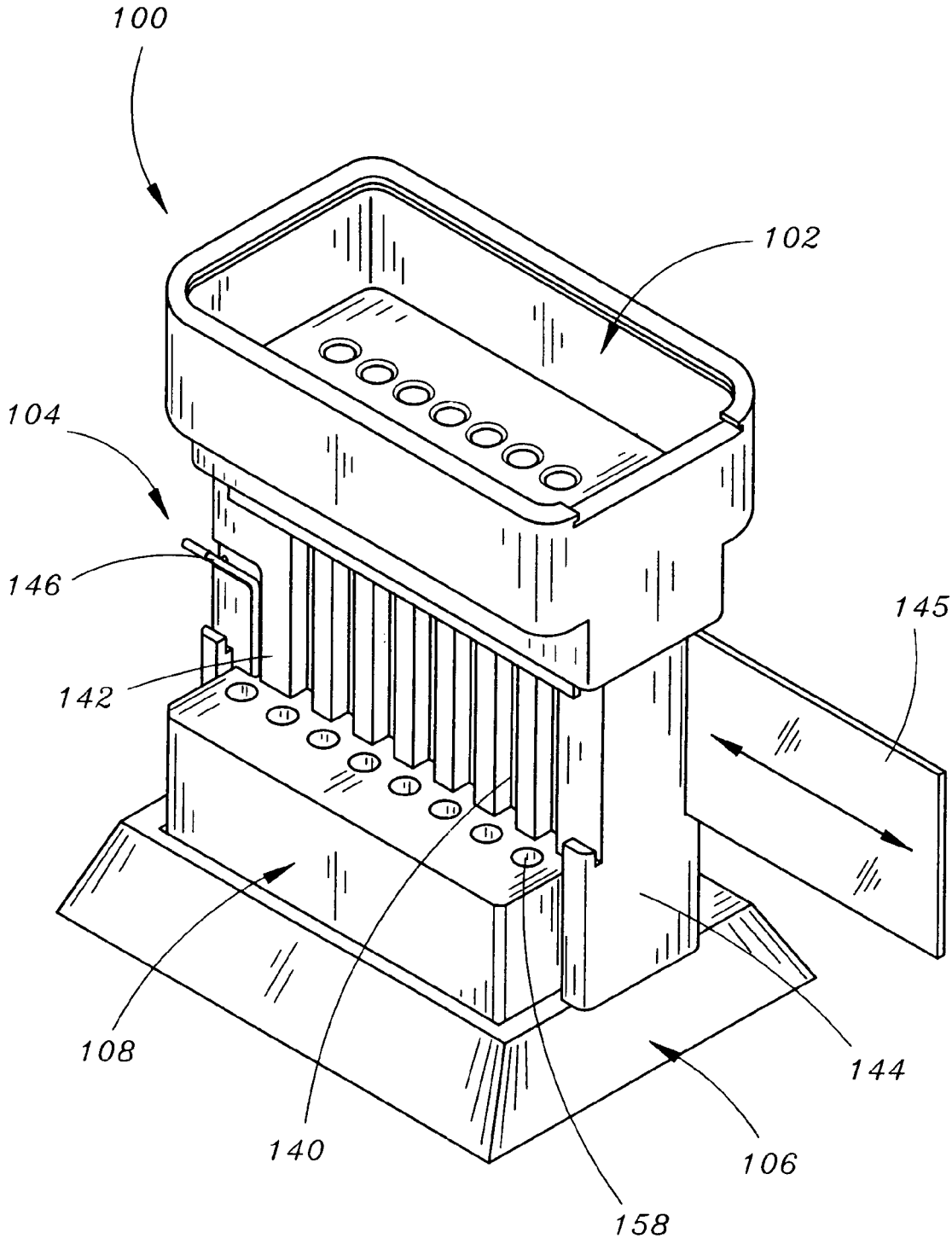
FIG. 1 is an isometric views illustrating a filler assembly in accordance with an exemplary embodiment of the present invention, wherein the filler assembly is capable of filling a unit-of-use medication container or dispenser.

Referring to FIG. 1, a filler assembly 100 capable of filling a unit-of-use medication container or dispenser 110 in accordance with an exemplary embodiment of the present invention is provided. In an embodiment, the filler assembly 100 includes a generally trough-shaped top 102 into which medication may be loaded. Further, a body 104 is operationally coupled to the top 102 for the transferring of medication from the top 102 of the filler assembly 110 into the unit of use medication dispenser 110. Additionally, a base 106 for supporting the filler assembly 100 and facilitating the coupling of the filler assembly 100 to the medication dispenser 110 is included. Moreover, a slide 108 is coupled to at least one of the body 104 and the base 106 for controlling the dispensing of medication by a user. It is contemplated that the top 102, body 104, base 106, and slide 108 of the filler assembly 100 may be formed of lightweight, inert synthetic or semi-synthetic materials such as plastic that may be molded, extruded, or machined into the specific components of the filler assembly 100. Such materials are advantageous for they are non-breakable, easy to lift and transport, and non-reactive with the medication.

Figure 2:
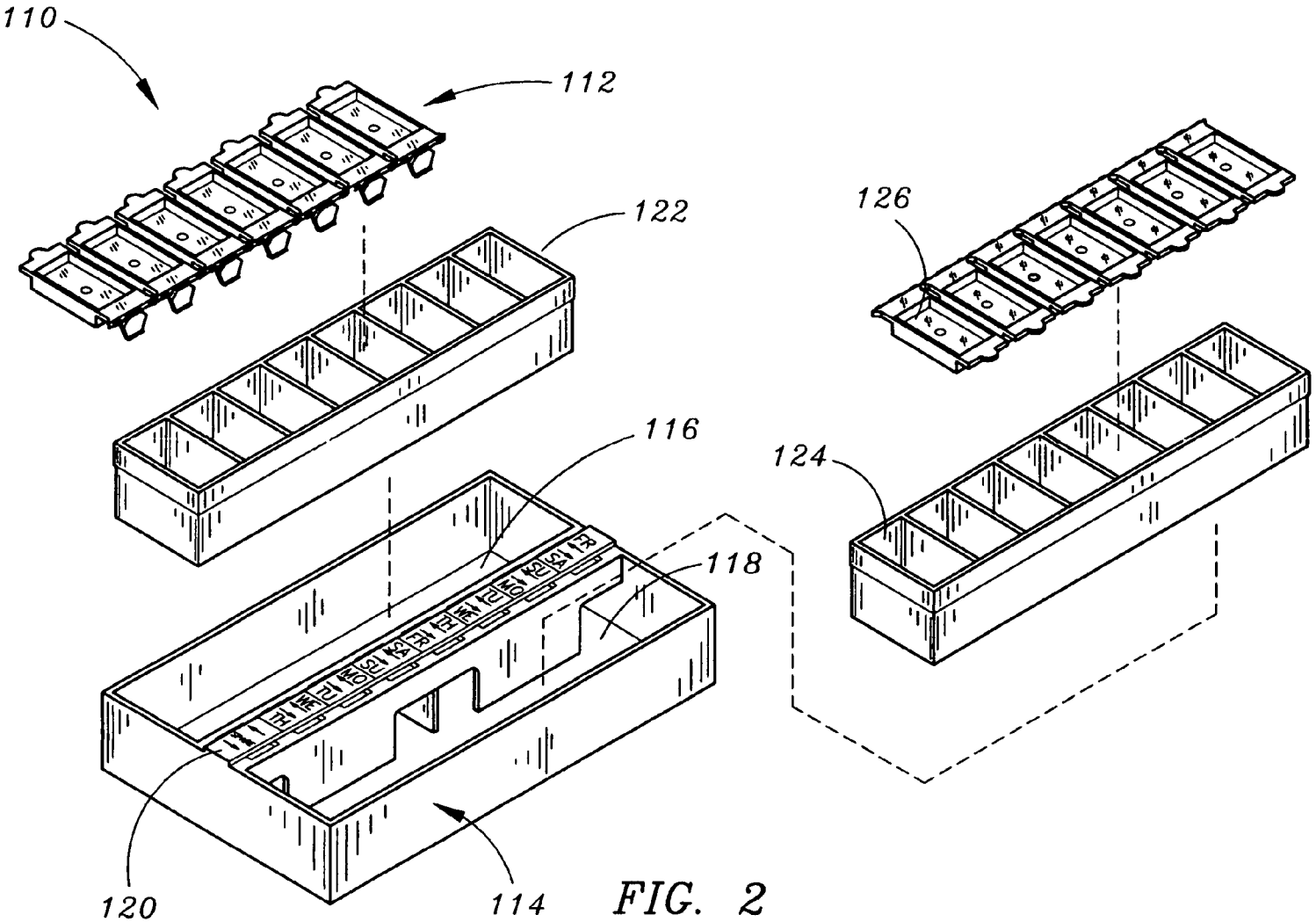
FIG. 2 is an is an exploded view of an exemplary unit-of-use medication dispenser, wherein the various components of such dispenser are provided.

Referring specifically now to FIG. 2, an illustration of an exemplary medication dispenser in accordance with the present invention is provided. In FIG. 2, the various components of the medication dispenser 110 may be observed. In the exemplary embodiment, the medication dispenser 110 includes a unitary cover assembly 112 designed to prevent the undetected removal of medication. Although the exemplary medication dispenser 110 is designed to dispense one type of medication, other exemplary embodiments may dispense more than one type of medication (e.g. are arranged to dispense two types of medication for one-week intervals each).

In FIG. 2, the medication dispenser 110 includes a container frame 114 which is divided into two sections 116 and 118. In the exemplary embodiment, an inner wall 120 is labeled with the days of the week or the word "spare." In the present embodiment, a two-week supply of medication is provided. As further illustrated in FIG. 2, the medication dispenser unit 110 is assembled by placing liners denoted as 122 in sections 116 and section 118 of the container frame 114. The unitary cover assembly 112 is then placed in alignment with the individual compartments 124 contained within the liner 122 so that each compartment 124 is covered with a cover 126.

It is contemplated that the number of compartments as well as the labeling of the medication dispenser 110 may vary depending upon user need. Further, although the cover assembly 112 is illustrated as being unitary, it is contemplated that in additional embodiments individual covers 126 may be positioned over the upper end of each compartment 124. It is preferred that the cover assembly 112 be unitary allowing for efficient attachment of the cover assembly 112 to the container frame 114. Further details of the medication dispenser 110 are disclosed in U.S. Pat. No. 5,735,406 and U.S. application Ser. No. 10/197,949, filed on Jul. 17, 2002 and U.S. Patent Application entitled "A Cover Assembly for a Medication Dispenser" filed on May 17, 2005 which are herein incorporated by reference in its entirety.

Figure 3:
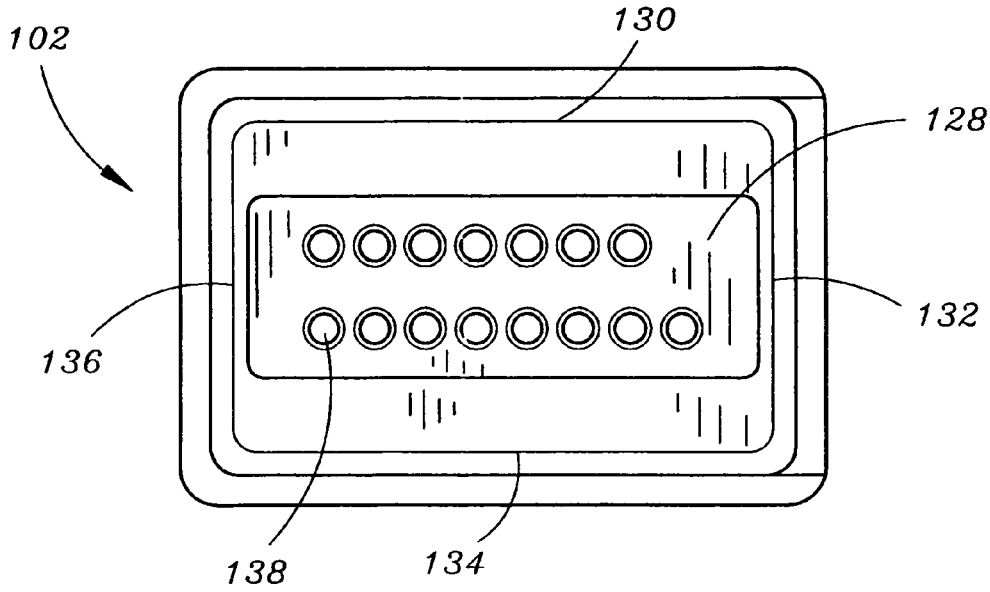
FIG. 3 is a top view of the filler assembly illustrated in FIG. 1.

Referring to FIG. 3, an exemplary embodiment of the top 102 of the filler assembly 100 is provided. As illustrated in FIG. 3, the exemplary top 102 is generally shaped as a rectangular trough which is formed by a generally horizontal bottom 128 surrounded by multiple sidewalls. For example, in the present embodiment, four sidewalls 130, 132, 134, and 136 surround the generally horizontal bottom 128 and extend upward therefrom forming a trough in which medication may be loaded. In addition, the exemplary embodiment includes apertures represented by 138 extending through the generally horizontal bottom 128 allowing medication which is loaded into the top 102 of the filler assembly 100 to be transferred to the body 104 of such assembly 100 when the top 102 is coupled to the body 104. In the exemplary embodiment, the top 102 is operationally coupled to the body 104 via a press fit. The use of a press fit coupling is advantageous for it provides a quick, secure attachment of the top 102 to the base 106 without requiring additional fastening devices. It is understood that additional mechanisms such as fasteners and the like may be employed to attach the top 102 to the body 104.

It is contemplated that in additional exemplary embodiments the top 102 may include a cover for covering the filler assembly 100 and providing protection of the contents therein while not in use. For example, a user may load the filler assembly 100 with the desired medication, dispense as needed, and then, leave the remaining medication within the filler assembly 100 for use at a later time. Such feature allows work flow to be improved for a user does not have to load the filler assembly 100 prior to each use. Further, storage needs are decreased for a user no longer needs to store the manufacture bottle/container in addition to the filler assembly 100. In addition, a label identifying the medication may be affixed to the filler assembly 100 to allow a user to readily identify the contents of the assembly 100.

Figure 4:
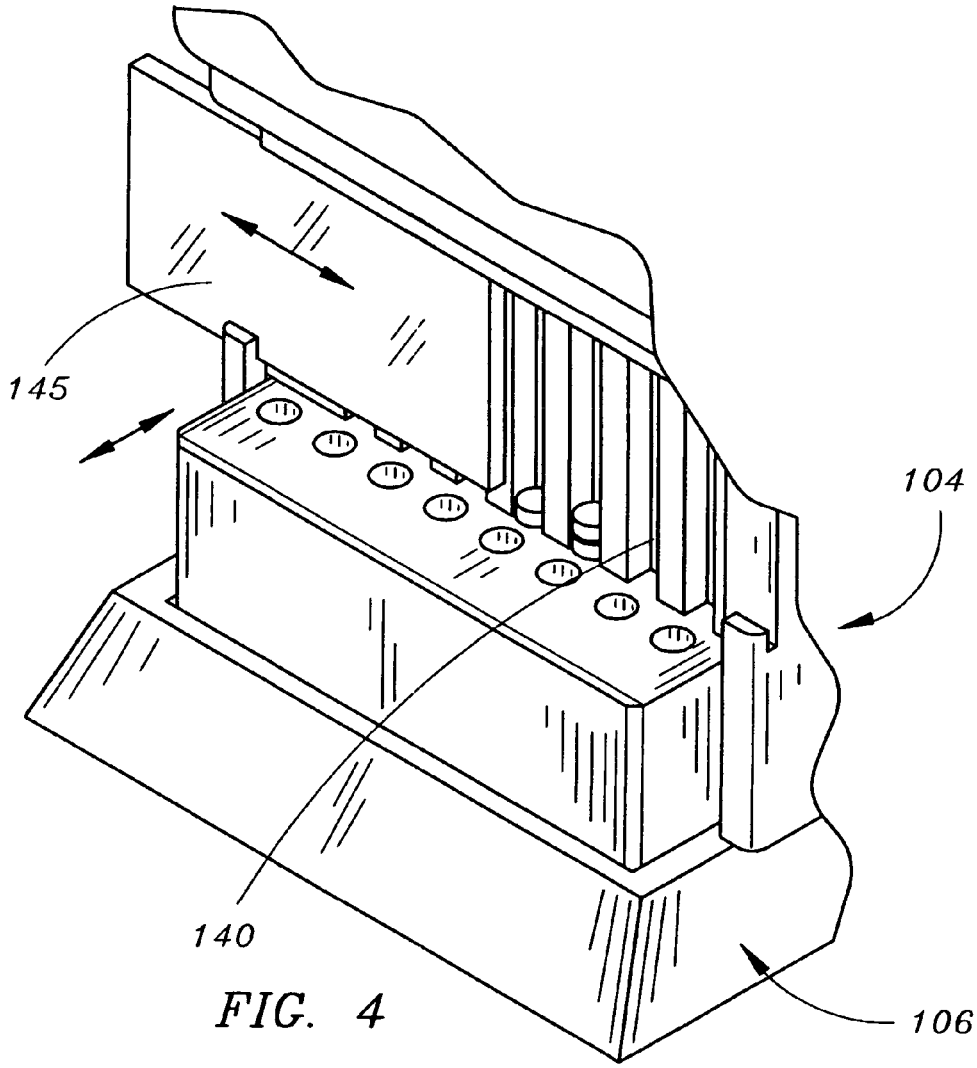
FIG. 4 is a partial side view of the filler assembly illustrated in FIG. 1, wherein the filler assembly includes a body with a plurality of chutes.

In further exemplary embodiments, as illustrated in FIGS. 1 and 4, the body 104 of the filler assembly 100 includes a plurality of sides and ends which are arranged to form a generally rectangular body. In the present exemplary embodiment, the body 104 includes two sides represented generally by 142 and two ends represented generally by 144. In such embodiment, the two sides 142 include a plurality of chutes referred to generally as 140. The plurality of chutes 140 are covered by a transparent cover 145 which allows a user to view the contents of each chute 140. Such a feature is beneficial for it allows the user to monitor pill position (e.g. visually ascertain that the pills are loaded in the chutes properly as well as observe changes in pill location when dispensing medication into a medication dispenser or container 110.) As described previously, in exemplary embodiments, the plurality of chutes 140 are aligned with their corresponding apertures within the top 102 to allow medication to be loaded into as well as stored within the body 104 of the filler assembly 102.

Figure 5:
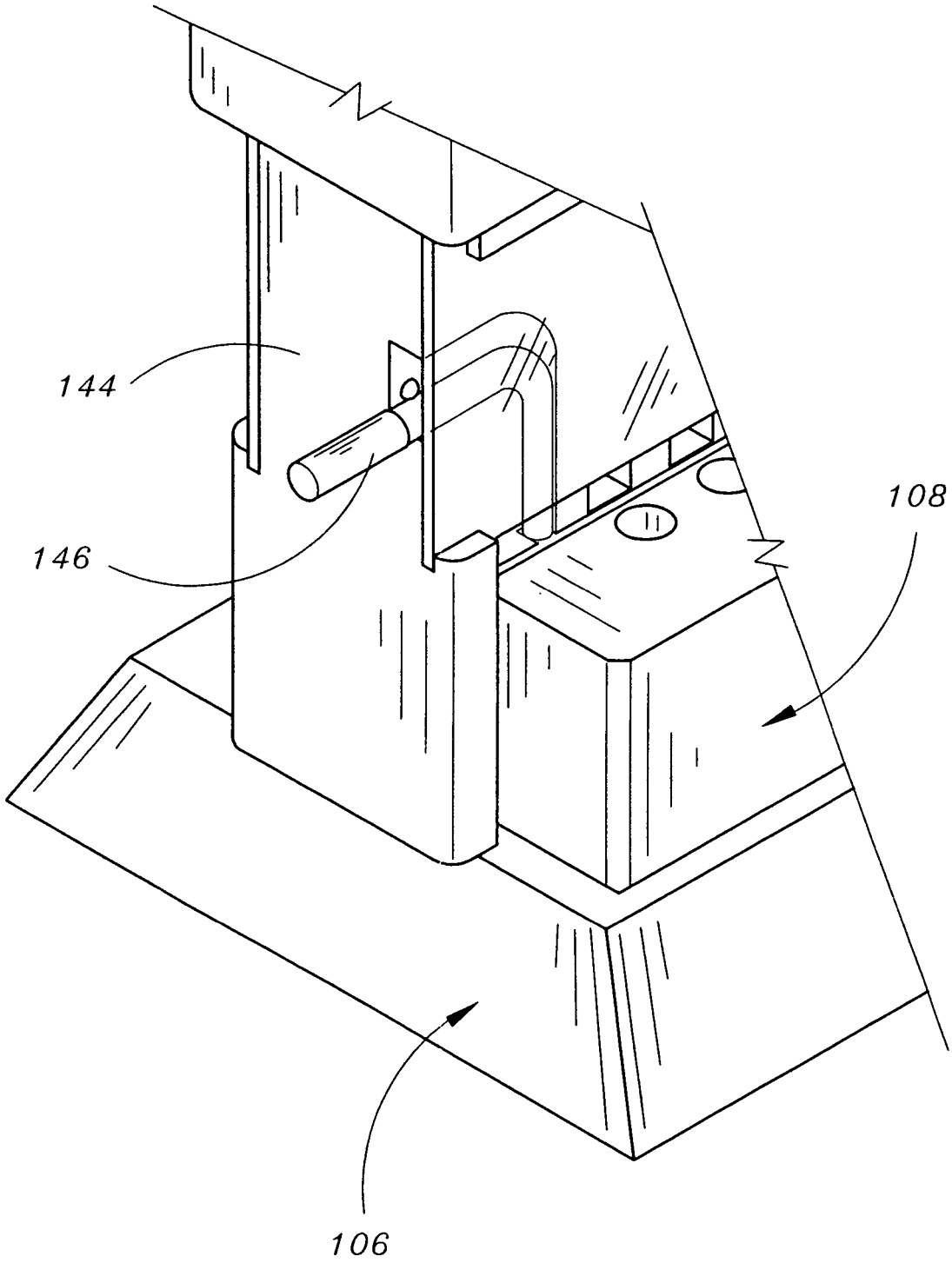
FIG. 5 is a partial front view of the filler assembly illustrated in FIG. 1, wherein the filler assembly includes a pill gauge.

In even further exemplary embodiments, the body 104 of the filler assembly 100 includes a as a locking device 146 to secure the filler assembly 100 during storage and transport. For example, the locking device may prevent a user from inadvertently dispensing medication while transporting the filler assembly from the shelf to a bench-top. In such example, the locking device may prevent medication from entering the chutes or the slide from moving. In an exemplary embodiment, as illustrated in FIGS. 1 and 5, the locking device 146 is a pin which may be positioned into a first position to lock the slide 108 and prevent slide 108 movement or into a second position which releases the slide 108 and allows a user to slide the slide 108 as needed.

In additional exemplary embodiments, the size of the plurality of chutes 140 may vary allowing different sized medications to be processed by different filler assemblies. Each chute may be configured so that only one pill/tablet/capsule is able to be dispensed at one time. This configuration increases the accuracy in which medication may be dispensed. In one exemplary embodiment, only the chute size within the filler assembly is varied whereby the top 102 and the base 106 are the same regardless of pill/tablet size. Such design allows efficient manufacturing of the assemblies at minimum cost while still providing the beneficial feature of accommodating variously sized pills/tablets. In use, a user may determine if a specific filler assembly may be employed to distribute a certain medication by measuring the pill/tablet/capsule size with a gauge prior to loading the filler assembly.

Figure 6A:
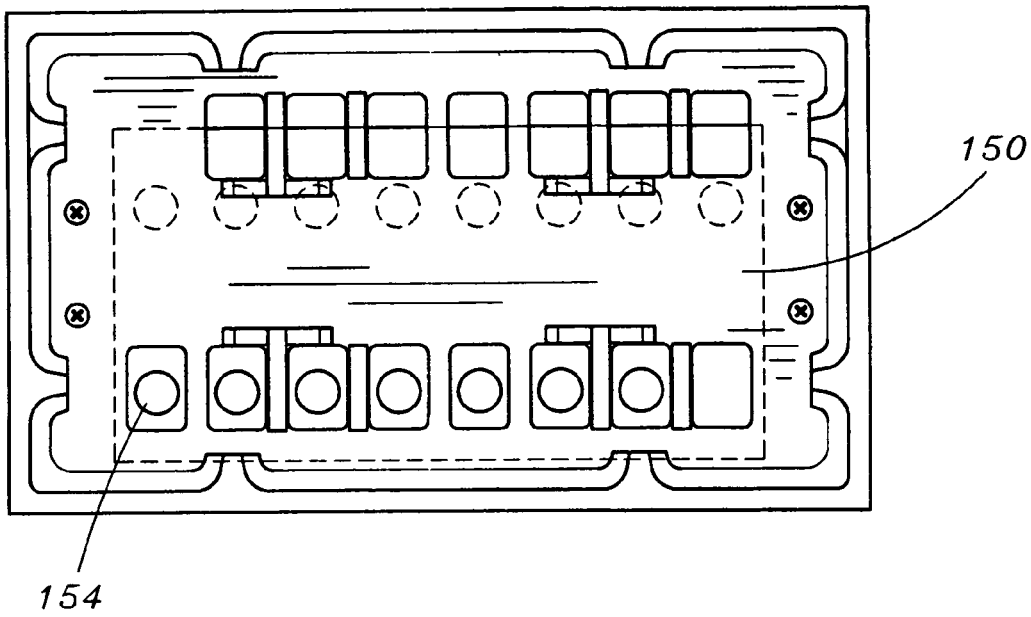
FIG. 6A is an isometric view of the bottom of the filler assembly, wherein the filler assembly includes a base.
Figure 6B:
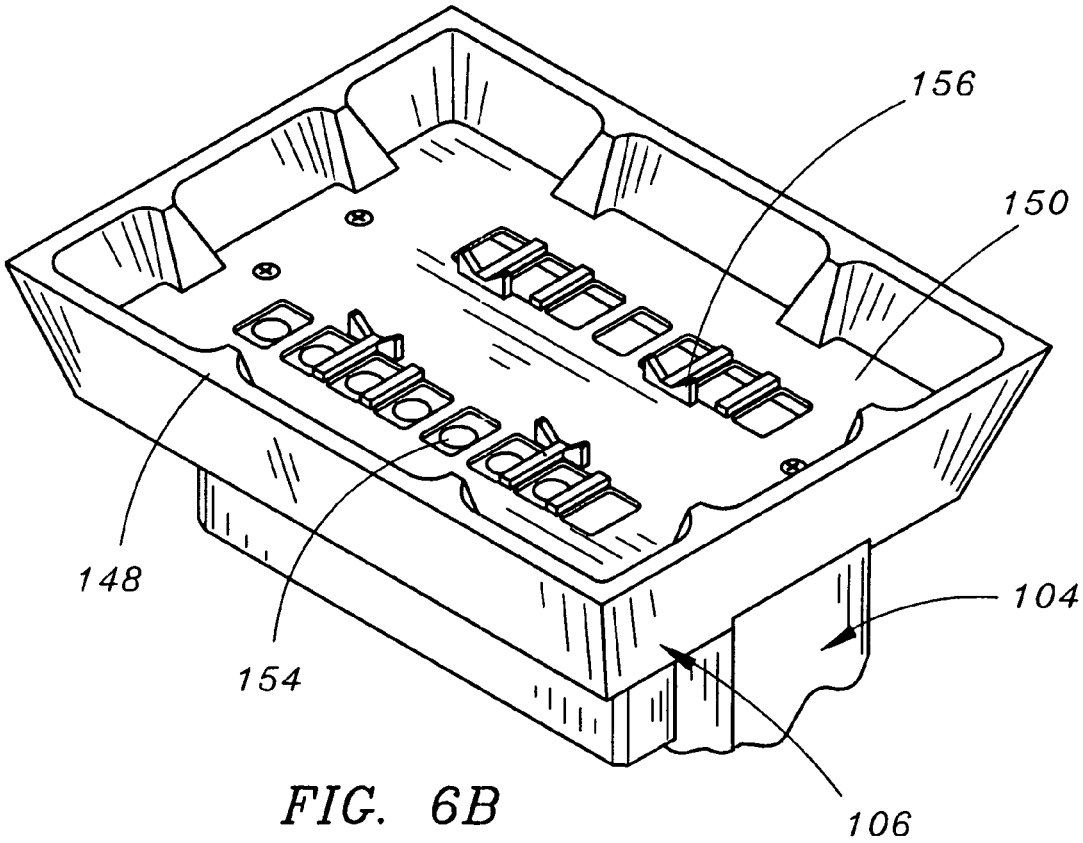
FIG. 6B is a top view of the bottom of the filler assembly illustrated in FIG. 1, wherein the base includes a plurality of apertures and positioners.

In even further exemplary embodiments, as illustrated in FIGS. 6A and 6B, the filler assembly 100 includes the base 106 for supporting the filler assembly 100 and facilitating the coupling of the filler assembly 100 to the medication dispenser 110. The base 106 includes a plurality of sides and ends which are arranged to form a generally rectangular base 106. In the present exemplary embodiment, the filler assembly 100 rests on one end of the edges (referred generally as 148) of the plurality of sides and ends of the base 106. Further, in the exemplary embodiment, the base 106 includes a generally horizontal bottom 150 which is coupled to the edges of the plurality of sides and ends of the base 106 opposing the edges 148 on which the filler assembly 100 rests in an upright position. The resulting configuration of the base 106 is a generally trough-shaped base bottom capable of receiving a medication dispenser 110.

In the exemplary embodiment illustrated in FIGS. 6A and 6B, the base 106 is operationally coupled to the body 104 of the filler assembly via fasteners. In such embodiment, the fasteners include screws which are inserted through apertures extending through the ends of the generally horizontal bottom 150 of the base 106 into corresponding apertures disposed within the ends 144 of the body 104 of the filler assembly 100. It is contemplated that additional fasteners may be employed without departing from the scope and spirit of the present invention.

In additional exemplary embodiments, as illustrated in FIGS. 6A and 6B, the base bottom 150 includes a plurality of apertures 154 and positioners 156. The plurality of apertures 154 extend through the base 106 whereby each aperture 154 aligns with one of the plurality of chutes 140. The plurality of apertures 154 and positioners 156 allow the medication held within the body 104 of the filler assembly to be transferred efficiently and accurately into the compartments 124 within the medication dispenser 110. For example, the plurality of positioners 156 allow the filler assembly 100 to be aligned and secured to the medication dispenser 110. In specific embodiments of the present invention, the plurality of positioners 156 may be disposed around the outer and the inner periphery of the base bottom 150. Further, such positioners may be generally V-shaped. The varying position of the positioners 156 allow the filler assembly 100 to be used with variously sized medication dispensers. For example, a first set of inner periphery positioners may be used to align and dispense medication into a medication dispenser of a first size whereby a second set of inner periphery positioners may be used to align and dispense medication into a medication dispenser of a second size. It is contemplated that the number, position, and shape of the positioners may vary depending upon user needs.

Figure 7:
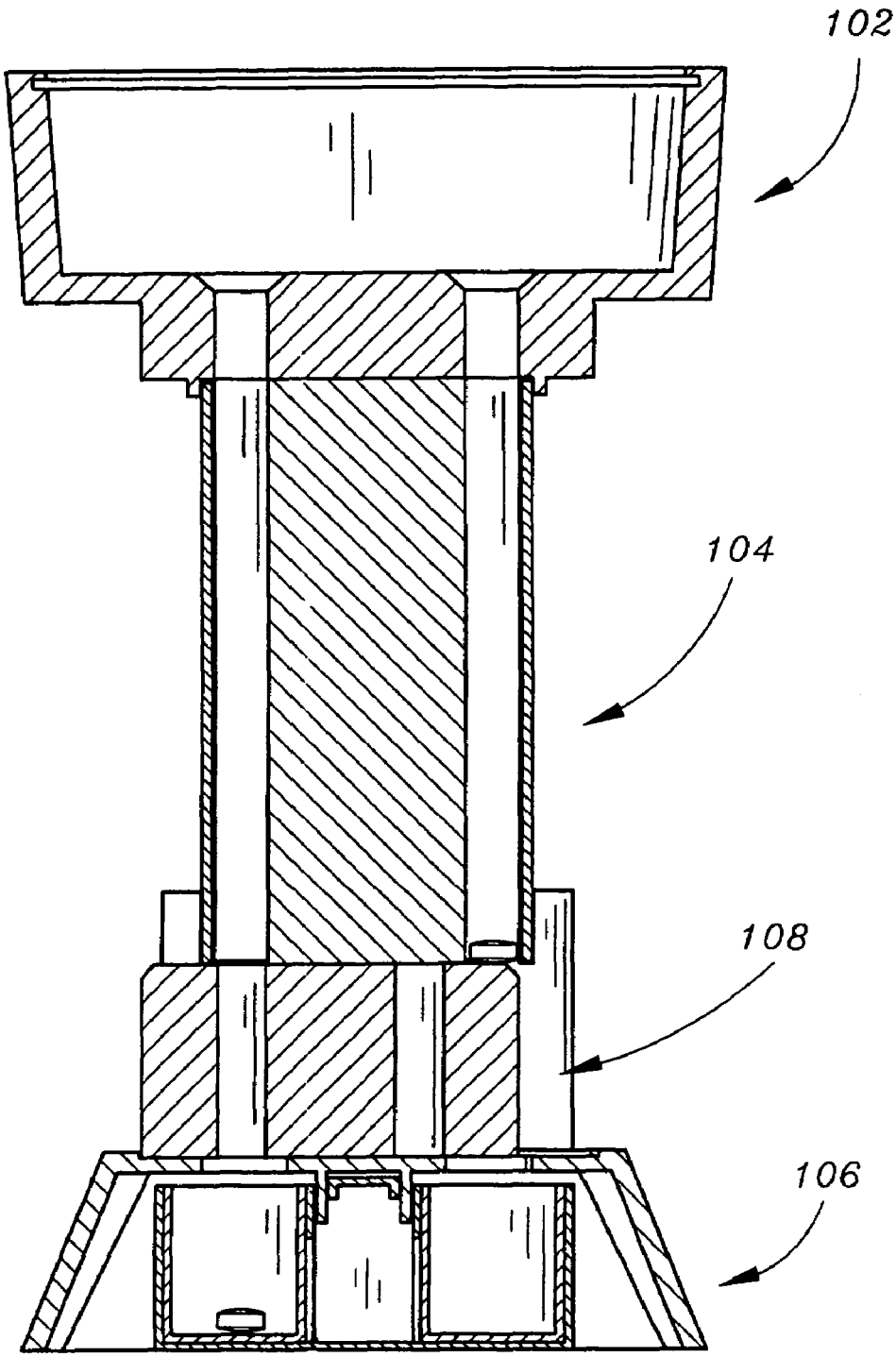
FIG. 7 is an isometric view of the slide illustrated in FIG. 1, wherein the slide is operationally coupled to the body and the base of the filler assembly for controlling the dispensing of medication by a user.

In another exemplary embodiment, as illustrated in FIG. 7, the filler assembly 100 includes a slide 108 which is operationally coupled to at least one of the body 104 and the base 106 for controlling the dispensing of medication by a user into a unit-of-use medication dispenser 110. In an exemplary embodiment, the slide 108 includes a plurality of apertures 158 (as illustrated in FIG. 1) which align with the plurality of chutes 140 disposed within the body 104 of the filler assembly 100. In the exemplary embodiment, the slide 108 is configured to have multiple positions. A first position may be the position in which each aperture 158 within the slide is in alignment with the corresponding chutes 140 disposed within the body 104 of the filler assembly 110. In such configuration, the apertures 154 within the base bottom 150 are not in alignment with the slide apertures 158. Such configuration allows an individual pill/tablet to occupy each of the apertures 158 within the slide 108. In order to dispense a unit of medication into a unit-of-use medication dispenser 110, a user slides the slide 108 of the filler assembly 100 over into a second position which aligns one row of the slide apertures 158 with one row of the base bottom apertures 154. The movement results in the filling of one row of compartments 124 within the medication dispenser 110 while loading the remaining row compartments 124 within the medication dispenser. Such configuration increase the efficiency in which the medication may be loaded and thus, dispensed for with one motion, the dispenser takes two actions—dispensing of medication into one row while simultaneously loading medication to dispensed into the second row.

Figure 8:
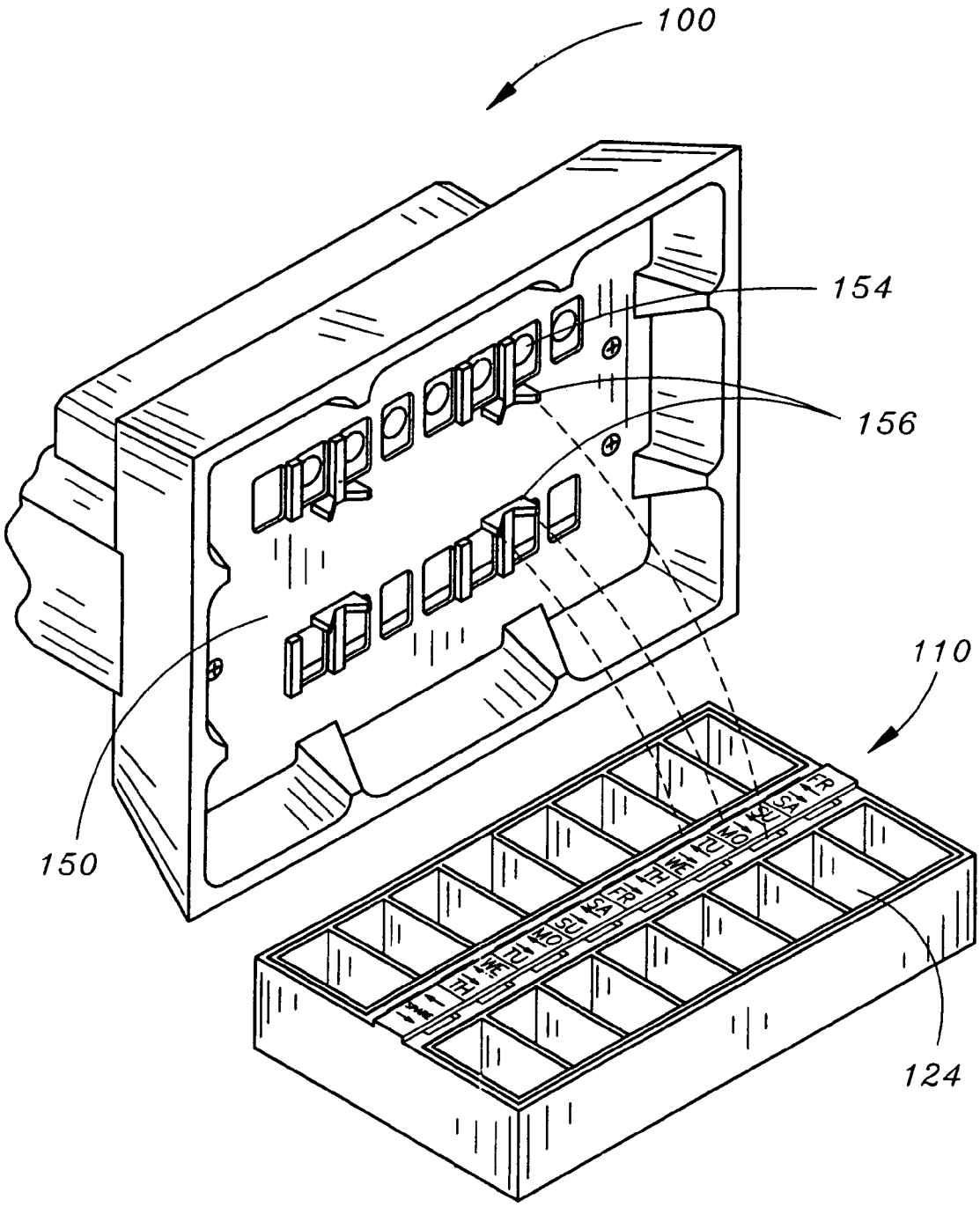
FIG. 8 is an illustration of a filler assembly in accordance with the present invention in alignment with an exemplary medication dispenser or container.

During exemplary use, medication may be loaded into the filler assembly 100 by pouring the pills/tablets into the top 102 of the filler assembly 100. The pills/tablets first enter the chutes 140 disposed within the body 104 of the filler assembly 100 through the apertures disposed within the top 102 of the filler assembly 100 with an individual tablet occupying each of the apertures 158 present within the slide 108. Such pills/tablets may be stored within the filler assembly 100 until use. A user may cover the top 102 of the filler assembly 100 to prevent dust and debris from entering the assembly 100 during non-use. Medication is then dispensed into the multiple compartments 124 of a unit-of-use medication dispenser 110 by the user aligning the plurality of positioners 156 disposed within the base bottom 150 with the medication dispenser and sliding the slide 108 of the filler assembly 100 from the first position to the second position (as illustrated in FIG. 8). The sliding of the slide 108 releases an individual tablet which was held within the slide 108 into each of the compartments 124 within the medication dispenser 110.

It is contemplated that additional embodiments of the presently disclosed filler assembly may include additional features such as a pill gauge for indicating the size of pill/tablet which the filler assembly is capable of distributing. Further, an additional embodiment may include a spring-loaded slide to assist a user in sliding the slide and minimizing the amount of force needed to be applied by the user to dispense medication.

It is understood that the specific order or hierarchy of steps in the methods disclosed are examples of exemplary approaches. Based upon design preferences, it is understood that the specific order or hierarchy of steps in the method can be rearranged while remaining within the scope and spirit of the present invention.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A filler assembly for a multi-compartment medication dispenser, comprising:

a top including a plurality of apertures;

a body coupled to the top for transferring medication from the top to the medication dispenser, the body including a plurality of sides and ends, the plurality of sides including a plurality of chutes covered by a transparent cover, the plurality of chutes being aligned with the apertures within the top;

a base for supporting the filler assembly and the coupling of the filler assembly to the medication dispenser, the base including a bottom, the bottom of the base including a plurality of apertures and positioners, the plurality of apertures extending through the base and each aperture aligning with one of the plurality of chutes; and a slide coupled to at least one of the body and the base for controlling the dispensing of medication by a user, the slide including a plurality of apertures;

wherein medication is dispensed into the multi-compartment medication dispenser by the user aligning the plurality of positioners disposed within the base bottom with the medication dispenser and sliding the slide for releasing an individual tablet into at least one of the compartments within the medication dispenser;

said plurality of positioners disposed within the bases are generally V-shaped.

2. A filler assembly for a multi-compartment medication dispenser, comprising:

a top including a plurality of apertures;

a body coupled to the top for transferring medication from the top to the medication dispenser, the body including a plurality of sides and ends, the plurality of sides including a plurality of chutes covered by a transparent cover, the plurality of chutes being aligned with the apertures within the top;

a base for supporting the filler assembly and the coupling of the filler assembly to the medication dispenser, the base including a bottom, the bottom of the base including a plurality of apertures and positioners, the plurality of apertures extending through the base and each aperture aligning with one of the plurality of chutes; and a slide coupled to at least one of the body and the base for controlling the dispensing of medication by a user, the slide including a plurality of apertures;

wherein medication is dispensed into the multi-compartment medication dispenser by the user aligning the plurality of positioners disposed within the base bottom with the medication dispenser and sliding the slide for releasing an individual tablet into at least one of the compartments within the medication dispenser;

said plurality of positioners including positioners disposed around an inner and outer periphery of the base portion;

said plurality of positioners being generally V-shaped allowing the filter assembly to be aligned with the medication dispenser.

3. A filler assembly for a multi-compartment medication dispenser, comprising:

a top including a plurality of apertures;

a body coupled to the top for transferring medication from the top to the medication dispenser, the body including a plurality of sides and ends, the plurality of sides including a plurality of chutes covered by a transparent cover, the plurality of chutes being aligned with the apertures within the top;

a base for supporting the filler assembly and the coupling of the filler assembly to the medication dispenser, the base including a bottom, the bottom of the base including a plurality of apertures and positioners, the plurality of apertures extending through the base and each aperture aligning with one of the plurality of chutes; and a slide coupled to at least one of the body and the base for controlling the dispensing of medication by a user, the slide including a plurality of apertures;

wherein medication is dispensed into the multi-compartment medication dispenser by the user aligning the plurality of positioners disposed within the base bottom with the medication dispenser and sliding the slide for releasing an individual tablet into at least one of the compartments within the medication dispenser;

said body including a locking device for securing the filter assembly to be aligned with the medication dispenser.

4. A filler assembly for a multi-compartment medication dispenser, comprising:

a top, the top being generally trough-shaped and including a generally horizontal bottom surrounded by multiple sidewalls, the generally horizontal bottom including apertures;

a body coupled to the top for transferring medication from the top to the medication dispenser, the body including a plurality of sides and ends, the plurality of sides including a plurality of chutes covered by a transparent cover, the plurality of chutes being aligned with the apertures within the top;

a base for supporting the filler assembly and the coupling of the filler assembly to the medication dispenser, the base including a bottom, the bottom of the base including a plurality of apertures and positioners, the plurality of apertures extending through the base and each aperture aligning with one of the plurality of chutes, the plurality of positioners being disposed around an outer periphery of the base bottom; and a slide coupled to at least one of the body and the base for controlling the dispensing of medication by a user, the slide includes a plurality of apertures;

wherein medication is dispensed into the multi-compartment medication dispenser by the user aligning the plurality of positioners disposed within the base bottom with the medication dispenser and sliding the slide which releases an individual tablet into each of the compartments within the medication dispenser;

said plurality of positioners disposed within the base being generally V-shaped allowing the filter assembly to be aligned with the medication dispenser.

5. A filler assembly for a multi-compartment medication dispenser, comprising:

a top, the top being generally trough-shaped and including a generally horizontal bottom surrounded by multiple sidewalls, the generally horizontal bottom including apertures;

a body coupled to the top for transferring medication from the top to the medication dispenser, the body including a plurality of sides and ends, the plurality of sides including a plurality of chutes covered by a transparent cover, the plurality of chutes being aligned with the apertures within the top;

a base for supporting the filler assembly and the coupling of the filler assembly to the medication dispenser, the base including a bottom, the bottom of the base including a plurality of apertures and positioners, the plurality of apertures extending through the base and each aperture aligning with one of the plurality of chutes, the plurality of positioners being disposed around an outer periphery of the base bottom; and a slide coupled to at least one of the body and the base for controlling the dispensing of medication by a user, the slide includes a plurality of apertures;

wherein medication is dispensed into the multi-compartment medication dispenser by the user aligning the plurality of positioners disposed within the base bottom with the medication dispenser and sliding the slide which releases an individual tablet into each of the compartments within the medication dispenser;

said body including a locking device for securing the filter assembly during transport and storage.

* * * * *